US011411347B2

(12) United States Patent
Wu et al.

(10) Patent No.: US 11,411,347 B2
(45) Date of Patent: Aug. 9, 2022

(54) COAXIAL CONNECTOR AND BOARD-TO-BOARD CONNECTOR ASSEMBLY

(71) Applicant: CommScope Technologies LLC, Hickory, NC (US)

(72) Inventors: JianPing Wu, Jiangsu (CN); Yujun Zhang, Jiangsu (CN); Jien Zheng, Jiangsu (CN); Lei Tie, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/089,914

(22) Filed: Nov. 5, 2020

(65) Prior Publication Data

US 2021/0143581 A1 May 13, 2021

(30) Foreign Application Priority Data

Nov. 11, 2019 (CN) ..... 201911093743.7

(51) Int. Cl.
*H01R 12/73* (2011.01)
*H01R 13/631* (2006.01)
(Continued)

(52) U.S. Cl.
CPC ..... *H01R 13/6315* (2013.01); *H01R 12/71* (2013.01); *H01R 13/2407* (2013.01); *H01R 2103/00* (2013.01)

(58) Field of Classification Search
CPC . H01R 13/6315; H01R 13/2407; H01R 12/91
(Continued)

(56) References Cited

U.S. PATENT DOCUMENTS 5,769,652 A 6/1998 Wider
5,980,290 A * 11/1999 Meynier ..... H01R 13/6315 439/246

(Continued)

FOREIGN PATENT DOCUMENTS

CN 1417898 A 5/2003
CN 201450195 U 5/2010
CN 105612665 B 8/2018

OTHER PUBLICATIONS

"International Search Report and Written Opinion corresponding to International Application No. PCT/2020/059284 dated Mar. 5, 2021".

(Continued)

*Primary Examiner* — Neil Abrams
(74) *Attorney, Agent, or Firm* — Myers Bigel, P.A.

(57) ABSTRACT

In a coaxial connector and a board-to-board connector assembly, the coaxial connector includes: a first coaxial connector portion including a first outer conductor, a first inner conductor, and a first dielectric spacer disposed between the first outer conductor and the first inner conductor; a second coaxial connector portion including a second outer conductor, a second inner conductor, and a second dielectric spacer disposed between the second outer conductor and the second inner conductor; and a first elastic element disposed between the first outer conductor of the first coaxial connector portion and the second outer conductor of the second coaxial connector portion. The first elastic element is configured such that the second coaxial connector portion is floatable axially and radially relative to the first coaxial connector portion, and the first elastic element is adapted to form an electrical connection between the first outer conductor and the second outer conductor.

14 Claims, 4 Drawing Sheets

(51) Int. Cl.
*H01R 13/24* (2006.01)
*H01R 12/71* (2011.01)
*H01R 103/00* (2006.01)

(58) Field of Classification Search
USPC ..... 439/63
See application file for complete search history.

(56) References Cited

U.S. PATENT DOCUMENTS 6,196,856 B1 * 3/2001 De Villeroche ... H01R 13/6315 439/248
6,224,407 B1 * 5/2001 Duquerroy ..... H01R 13/6315 439/188
6,497,579 B1 * 12/2002 Garbini ..... H01R 13/6315 439/63
6,520,998 B1 * 2/2003 Scholler ..... H01R 13/187 439/843
6,699,054 B1 3/2004 Critelli
7,416,418 B2 * 8/2008 Berthet ..... H01R 24/50 439/66
8,597,050 B2 * 12/2013 Flaherty ..... H01R 31/06 439/578
9,490,052 B2 * 11/2016 Stein ..... H01R 13/502
10,249,968 B2 * 4/2019 Dandl ..... H01R 12/716
10,446,955 B2 * 10/2019 Hoyack ..... H01R 13/658
10,505,303 B2 * 12/2019 Hoyack ..... H01R 12/91
2020/0091639 A1 * 3/2020 Meynier ..... H01R 12/91
2021/0143568 A1 * 5/2021 Zheng ..... H01R 12/91
2021/0143581 A1 * 5/2021 Wu ..... H01R 13/2407

OTHER PUBLICATIONS

"International Preliminary Report on Patentability corresponding to International Application No. PCT/2020/059284 dated May 27, 2022".

* cited by examiner

COAXIAL CONNECTOR AND BOARD-TO-BOARD CONNECTOR ASSEMBLY

RELATED APPLICATION

The present application claims priority from and the benefit of Chinese Application No. 201911093743.7, filed Nov. 11, 2019, the disclosure of which is hereby incorporated herein by reference in its entirety.

FIELD OF THE INVENTION

The present disclosure relates generally to cable connectors. More particularly, the present disclosure relates to self-adaptive coaxial connectors and board-to-board connector assemblies including the same.

BACKGROUND OF THE INVENTION

Coaxial cables are commonly utilized in radio frequency (RF) communication systems. Coaxial cable connectors may be applied to terminate coaxial cables, for example, in communication systems requiring a high level of precision and reliability.

The coaxial connector interfaces provide a connect/disconnect functionality between (a) a cable terminated with a connector bearing the desired connector interface and (b) a corresponding connector with a mating connector interface mounted on an electronic device or another cable.

In some cases, the coaxial connector interfaces may be configured with a blind-mating characteristic to enable push-on interconnection. Such blind-mating coaxial connector interfaces are particularly suitable for board-to-board connector assemblies, in which a plurality of coaxial connector interfaces are mounted on two printed circuit boards that are generally disposed parallel to one another respectively.

However, in the blind-mating coaxial connector interfaces, especially in the board-to-board connector assemblies equipped with a plurality of blind-mating coaxial connector interfaces, the interconnect portions of the coaxial connector interfaces may be difficult to align accurately due to inconsistent processing and/or mounting precision of the coaxial connector interfaces and/or deformation of the printed circuit boards in use, which may have a negative effect on the return loss performance and PIM characteristics of the connectors. Therefore, there is still room for improvement in the blind-mating coaxial connector interfaces.

SUMMARY OF THE INVENTION

One of objects of the present disclosure is to provide a coaxial connector and a board-to-board connector assembly including the same that can overcome at least one of drawbacks in the prior art.

In the first aspect of the present disclosure, a coaxial connector is provided. The coaxial connector comprises: a first coaxial connector portion including a first outer conductor, a first inner conductor, and a first dielectric spacer disposed between the first outer conductor and the first inner conductor; a second coaxial connector portion including a second outer conductor, a second inner conductor, and a second dielectric spacer disposed between the second outer conductor and the second inner conductor; and a first elastic element disposed between the first outer conductor of the first coaxial connector portion and the second outer conductor of the second coaxial connector portion; wherein the first elastic element is configured such that the second coaxial connector portion is floatable axially and radially relative to the first coaxial connector portion, and the first elastic element is adapted to form an electrical connection between the first outer conductor and the second outer conductor.

According to an embodiment of the present disclosure, the first elastic element is a leaf spring.

According to an embodiment of the present disclosure, the first elastic element is made of beryllium copper or phosphor copper.

According to an embodiment of the present disclosure, the first inner conductor is in the form of a pin or a post, a proximal portion of the second inner conductor is provided with an elastic component, wherein the first inner conductor is configured to be in contact with the elastic component to form an electrical connection between the first inner conductor and the second inner conductor.

According to an embodiment of the present disclosure, the elastic component is a second elastic element, wherein the proximal portion of the second inner conductor includes a cavity for receiving the first inner conductor, and the second elastic element is disposed in the cavity.

According to an embodiment of the present disclosure, the second elastic element is a waist-drum spring.

According to an embodiment of the present disclosure, the second elastic element is made of beryllium copper or phosphor copper.

According to an embodiment of the present disclosure, the elastic component is configured to include a plurality of resilient fingers disposed in a circumferential direction, and a proximal end of each resilient finger is provided with a protrusion protruding radially inwardly, wherein the protrusion has an arc-shaped outer surface.

According to an embodiment of the present disclosure, an inner circumferential surface of the first outer conductor is provided with threads, and an outer circumferential surface of the second outer conductor is provided with mating threads, wherein the mating threads is capable of being screwed beyond the threads and into the first coaxial connector portion.

According to an embodiment of the present disclosure, the mating threads are configured as reverse threads.

In the second aspect of the present disclosure, a board-to-board connector assembly is provided. The board-to-board connector assembly comprises: a first printed circuit board and a second printed circuit board disposed substantially parallel to each other; at least one first coaxial connector mounted to the first printed circuit board, wherein the first coaxial connector is configured as the coaxial connector of any one of claims 1 to 10; and at least one second coaxial connector mounted to the second printed circuit board, wherein the second coaxial connector is capable of mating with the first coaxial connector.

According to an embodiment of the present disclosure, the second coaxial connector includes an outer conductor, an inner conductor, and a dielectric spacer disposed between the outer conductor and the inner conductor of the second coaxial connector, wherein a proximal portion of the inner conductor of the second coaxial connector is provided with an elastic component, and the second inner conductor of the first coaxial connector is configured to contact the elastic component of the inner conductor of the second coaxial connector so as to form an electrical connection between the second inner conductor of the first coaxial connector and the inner conductor of the second coaxial connector.

According to an embodiment of the present disclosure, the elastic component of the inner conductor of the second coaxial connector is a third elastic element, and the proximal portion of the inner conductor of the second coaxial connector includes a second cavity for receiving the second inner conductor of the first coaxial connector, wherein the third elastic element is disposed in the second cavity.

According to an embodiment of the present disclosure, the third elastic element is a waist-drum spring.

According to an embodiment of the present disclosure, the third elastic element is made of beryllium copper or phosphor copper.

According to an embodiment of the present disclosure, the board-to-board connector assembly includes a plurality of first coaxial connectors and a plurality of second coaxial connectors, wherein the plurality of first coaxial connectors and the plurality of second coaxial connectors are disposed on the first printed circuit board and the second printed circuit board respectively in a same array.

According to an embodiment of the present disclosure, the first printed circuit board is mounted on a base station antenna, and the second printed circuit board is mounted on a remote radio unit.

BRIEF DESCRIPTION OF THE DRAWINGS

After reading the embodiments described below in combination with the drawings, a plurality of aspects of the present disclosure will be better understood. In the drawings.

DETAILED EMBODIMENTS

Figure 1:
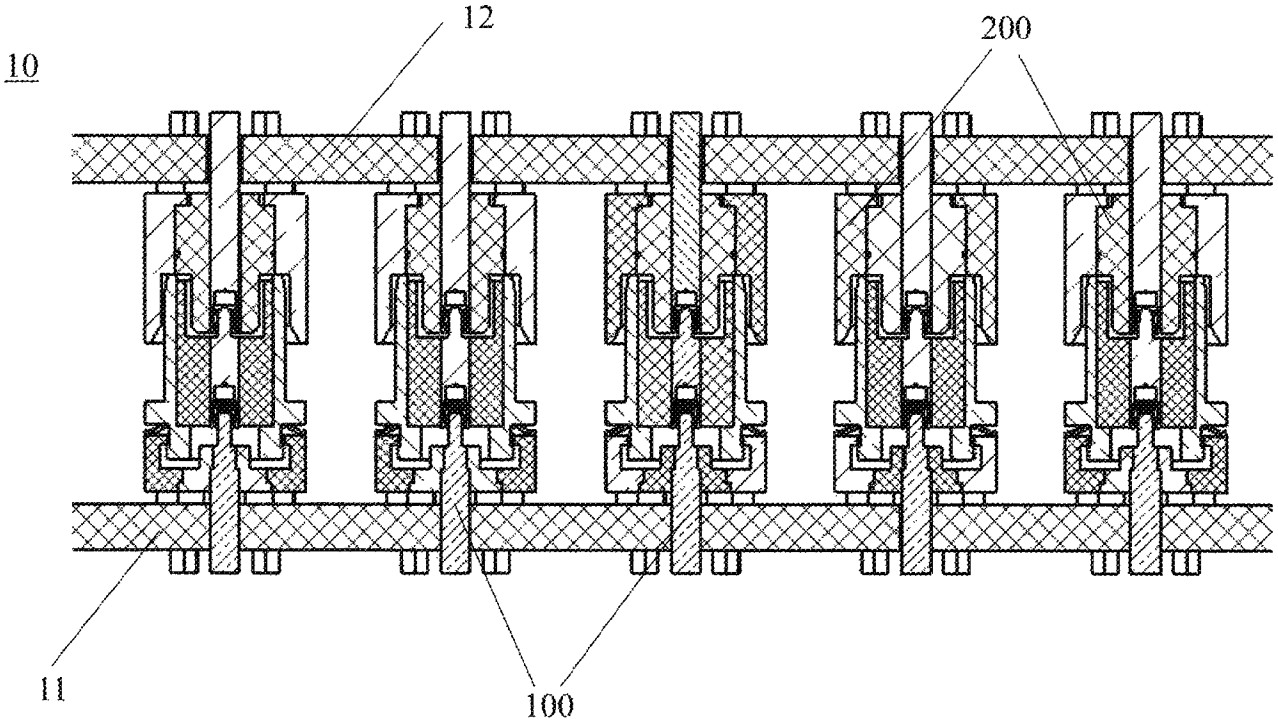
FIG. 1 is a cross-sectional view of a board-to-board connector assembly according to an embodiment of the present disclosure.

The present disclosure will be described below with reference to the drawings, in which several embodiments of the present disclosure are shown. It should be understood, however, that the present disclosure may be implemented in many different ways and may not be limited to the example embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein can be combined in various ways to provide many additional embodiments.

It should be understood that, in all the drawings, the same reference signs present the same elements. In the drawings, for the sake of clarity, the sizes of certain features may be modified.

It should be understood that, the wording in the specification is only used for describing particular embodiments and is not intended to limit the present disclosure. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an" and "the" as used in the specification, unless clearly indicated, all contain the plural forms. The words "comprising", "containing" and "including" used in the specification indicate the presence of the claimed features, but do not preclude the presence of one or more additional features. The wording "and/or" as used in the specification includes any and all combinations of one or more of the relevant items listed.

The terms "first", "second" and "third" are used in the specification for ease of description and are not intended to be limiting. Any technical features represented by the terms "first", "second" and "third" are interchangeable.

The letters "P" and "D" used in the drawings indicate "proximal" and "distal" directions respectively. Unless expressly stated otherwise, phrases referring to a "proximal" end or "proximal" side of an element may be deemed to refer to a portion that is closer to P than other portions of the same element. Likewise, unless expressly stated otherwise, phrases referring to a "distal" end or "distal" side of an element may be deemed to refer to a portion that is closer to D than other portions of the same element.

Referring now to the drawings, FIG. 1 shows a board-to-board connector assembly 10 according to an embodiment of the present disclosure. The board-to-board connector assembly 10 may include a first printed circuit board 11, a second printed circuit board 12, at least one first coaxial connector 100 mounted to the first printed circuit board 11, and at least one second coaxial connector 200 mounted to the second printed circuit board 12. The first coaxial connector 100 is capable of mating with the second coaxial connector 200. In the case where the board-to-board connector assembly 10 includes a plurality of first coaxial connectors 100 and a plurality of second coaxial connectors 200, the plurality of first coaxial connectors 100 and the plurality of second coaxial connectors 200 may be disposed on the first printed circuit board 11 and the second printed circuit board 12, respectively, in a same array.

The first printed circuit board 11 and the second printed circuit board 12 may be of conventional construction, and may include conductive traces, vias, and electronic components for transmitting electrical signals. In use, the first printed circuit board 11 and the second printed circuit board 12 are generally disposed parallel to each other. The first printed circuit board 11 may be mounted on a piece of communication device, such as a base station antenna, and the second printed circuit board 12 may be mounted on a separate piece of communication device, such as a remote radio unit (RRU).

Figure 2:
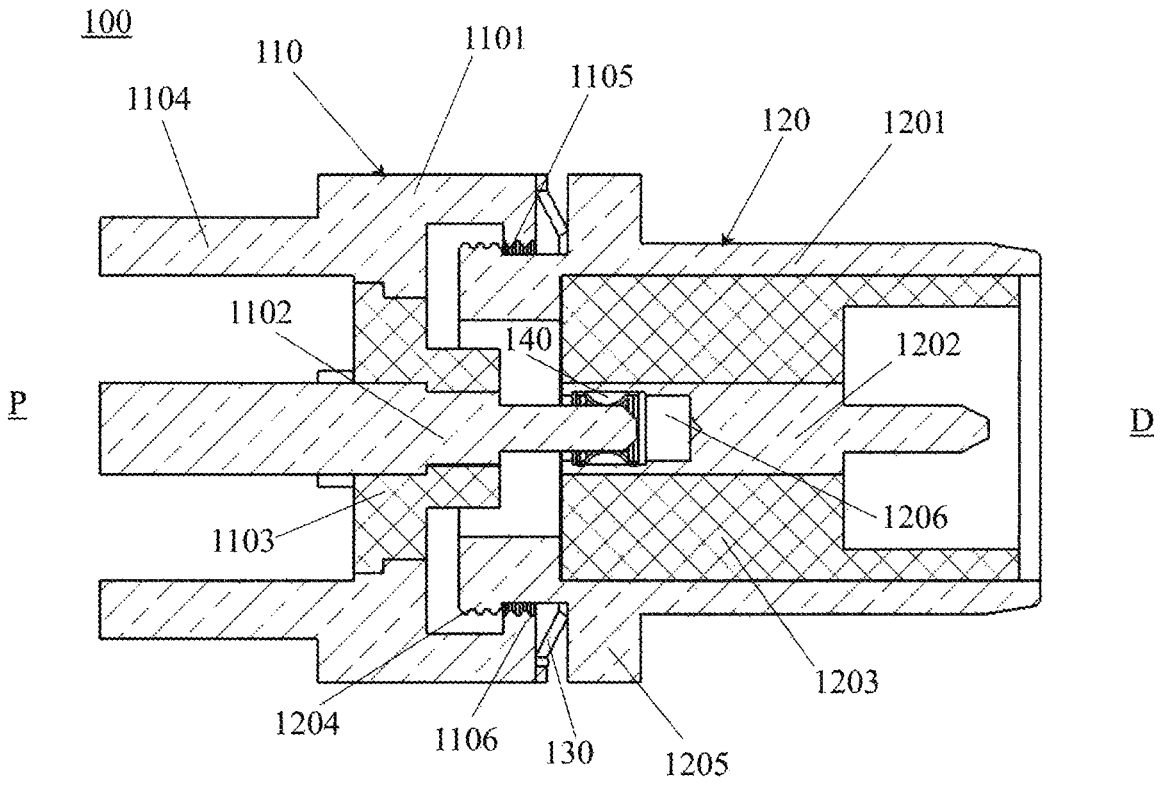
FIG. 2 is a cross-sectional view of a first coaxial connector according to an embodiment of the present disclosure.
Figure 3:
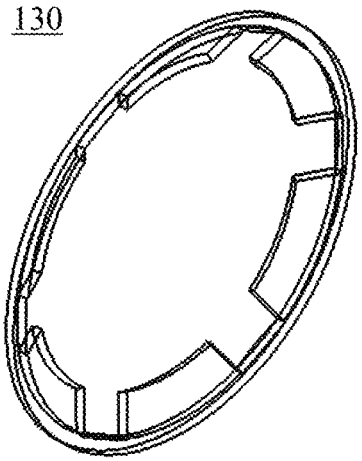
FIG. 3 shows an embodiment of a first elastic element for use in the first coaxial connector of FIG. 2.
Figure 4:
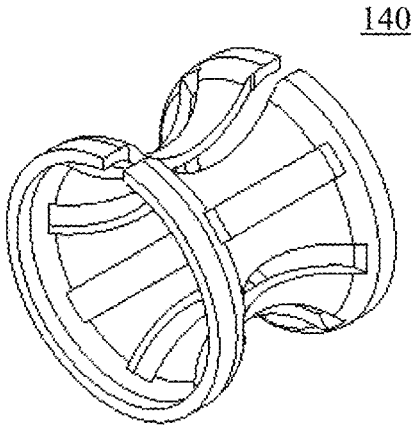
FIG. 4 shows an embodiment of a second elastic element for use in the first coaxial connector of FIG. 2.

Referring to FIGS. 2-4, a specific structure of the first coaxial connector 100 according to one embodiment of the present disclosure is illustrated. The first coaxial connector 100 may be constructed as a male connector. The first coaxial connector 100 is constructed as a split-type structure, and includes a first coaxial connector portion 110 and a second coaxial connector portion 120, wherein the second coaxial connector portion 120 is floatable axially and radially with respect to the first coaxial connector portion 110.

In the present disclosure, the term "floatable" may refer to "movable linearly" as well as "tiltable or deflectable". For example, "floatable axially" may refer to "movable linearly in an axial direction", and "floatable radially" may refer to "tiltable or deflectable in a radial direction".

Since the second coaxial connector portion 120 is floatable axially with respect to the first coaxial connector portion 110, the length of the first coaxial connector 100 can be adjusted, which makes the first coaxial connector 100 adjustable between two printed circuit boards spaced apart from each other at different intervals. Since the second coaxial connector portion 120 is floatable radially relative to the first coaxial connector portion 110, the first coaxial connector 100 may blind-mate with the second coaxial connector 200 smoothly and may be maintained in a good working condition even in case that the printed circuit boards are deformed, or the first coaxial connector 100 and the second coaxial connector 200 are not mounted on the printed circuit boards precisely.

The first coaxial connector portion 110 includes a first outer conductor 1101, a first inner conductor 1102, and a first dielectric spacer 1103 disposed between the first outer conductor 1101 and the first inner conductor 1102 and spacing them from each other. The first outer conductor 1101 has a generally cylindrical shape and includes a proximal portion and a distal portion. The proximal portion of the first outer conductor 1101 is provided with at least one pin 1104 extending axially from a proximal end surface of the first outer conductor 1101 towards the proximal side P. By means of pin 1104, the first outer conductor 1101 may be welded on the first printed circuit board 11. An inner circumferential surface of the distal portion of the first outer conductor 1101 is provided with a thread 1105. In one embodiment according to the present disclosure, the distal portion of the first outer conductor 1101 includes an annular protrusion 1106 that protrudes radially inwardly, and the threads 1105 may be disposed on a bottom surface of the annular protrusion 1106. The first inner conductor 1102 is configured as an elongated element such as a pin or a post.

The second coaxial connector portion 120 includes a second outer conductor 1201, a second inner conductor 1202, and a second dielectric spacer 1203 disposed between the second outer conductor 1201 and the second inner conductor 1202 and spacing them from each other. The second outer conductor 1201 has a generally cylindrical shape and includes a proximal portion and a distal portion. An outer circumferential surface of the proximal portion of the second outer conductor 1201 is provided with threads 1204. The threads 1204 extend a certain length axially from a proximal end of the second outer conductor 1201 towards the distal side D. The threads 1204 may be engaged with threads 1105 on the distal portion of the first outer conductor 1101. The outer circumferential surface of the proximal portion of the second outer conductor 1201 further includes a step portion 1205. The step portion 1205 is spaced apart from the thread 1204 by a certain distance in the axial direction. The second inner conductor 1202 is configured as an elongated element such as a pin or a post, and includes a proximal portion and a distal portion. The proximal portion of the second inner conductor 1202 is provided with a cavity 1206 for receiving the first inner conductor 1102 of the first coaxial connector portion 110. The cavity 1206 is open toward the proximal side.

In the process of fitting into the first coaxial connector 100, the first coaxial connector portion 110 and the second coaxial connector portion 120 may be connected together by rotating the second coaxial connector portion 120 with the mating of the threads 1204 and the threads 1105. In the embodiment according to the present disclosure, the threads 1204 of the second coaxial connector portion 120 may be screwed beyond the threads 1105 and into the first coaxial connector portion 110, allowing the second coaxial connector portion 120 to be floatable axially and radially within the first coaxial connector portion 110, but not to be translated out of the first coaxial connector portion 110 due to the interference of teeth of the threads 1204 and teeth of the threads 1105.

In another embodiment of the present disclosure, the inner circumferential surface of the distal portion of the first outer conductor 1101 of the first coaxial connector portion 110 may be provided with at least one projection, and the outer circumferential surface of the proximal portion of the second outer conductor 1201 of the second coaxial connector portion 120 may be provided with at least one slot that could receive the at least on projection. The slot may be configured to include an axial portion and a circumferential portion. For example, the slot may be configured as a "L" shaped slot. When fitting the first coaxial connector portion 110 and the second coaxial connector portion 120 into the first coaxial connector 100, the projection of the first coaxial connector portion 110 is aligned with the slot of the second coaxial connector portion 120, the first coaxial connector portion 110 and/or the second coaxial connector portion 120 are pushed toward each other axially and then are rotated relative to each other when the projection travels to the end of the axial portion of the slot, so that the projection will enter the circumferential portion of the slot and thus connector the first coaxial connector portion 110 and the second coaxial connector portion 120. The configuration and the size of the circumferential portion of the slot could be configured such that the projection could be captured in the circumferential portion while the second coaxial connector portion 120 is still floatable axially relative to the first coaxial connector portion 110. The projection of the first coaxial connector portion 110 may be configured to have a shape of a ball, a half-ball, a cylinder, and so on. The projection may be formed integrally with the first out connector 1101, but also may be a ball, a pin, and the like received in a corresponding cavity provide in the first out connector 1101.

A first elastic element 130 is disposed between the first outer conductor 1101 of the first coaxial connector portion 110 and the second outer conductor 1201 of the second coaxial connector portion 120. The first elastic element 130 is disposed between and in contact with the distal end surface of the first outer conductor 1101 and the step portion 1205 of the second outer conductor 1201, so as to form an electrical connection between the first outer conductor 1101 and the second outer conductor 1201 while enabling the second coaxial connector portion 120 to float axially and radially relative to the first coaxial connector portion 110. In the initial state, the first elastic element 130 can space the step portion 1205 of the second outer conductor 1201 from the distal end surface of the first outer conductor 1101 by a predetermined distance, so as to keep the first coaxial connector portion 110 and the second coaxial connector portion 120 at an initial position and to keep the first coaxial connector portion 110 and the second coaxial connector portion 120 as coaxial as possible. In the compressed state, the first elastic element 130 is capable of being compressed by pushing of the step portion 1205 of the second outer conductor 1201, so that the second coaxial connector portion 120 can approach the first coaxial connector portion 110 to adjust the length of the first coaxial connector 100. Further, when the second coaxial connector portion 120 floats radially relative to the first coaxial connector portion 110, the first elastic element 130, stressed unevenly, may generate an uneven restoring force. This restoring force is helpful for the second coaxial connector portion 120 to tend to return to the state that the second coaxial connector portion 120 is coaxial with the first coaxial connector portion 110, so that the first coaxial connector 100 and the second coaxial connector 200 can be maintained in a good condition of contact, which thus ensures a high return loss performance and good PIM characteristics between the first coaxial connector 100 and the second coaxial connector 200.

The first elastic element 130 may be constructed in the form of a leaf spring. In the embodiment shown in FIG. 3, the first elastic element 130 is constructed in the form of a six-legged leaf spring. However, the present disclosure is not limited thereto, and the first elastic element 130 may be configured as a three-legged leaf spring, four-legged leaf spring, five-legged leaf spring, eight-legged leaf spring, a circular leaf spring, a coil spring, a compressible pad, or any other form of elastic elements.

A second elastic element 140 is disposed within the cavity 1206 of the second inner conductor 1202 of the second coaxial connector portion 120. The second elastic element 140 is configured to contact both the first inner conductor 1102 of the first coaxial connector portion 110 and the second inner conductor 1202 of the second coaxial connector 120, so as to form an electrical connection between the first inner conductor 1102 and the second inner conductor 1202. Further, the second elastic member 140 is elastically deformable, such that when the first inner conductor 1102 is inserted into the cavity 1206 of the second inner conductor 1202, the first inner conductor 1102 may not obstruct the radial floating of the second coaxial connector portion 120 relative to the first coaxial connector portion 110.

In the embodiment shown in FIG. 4, the second elastic element 140 is constructed in the form of a waist-drum spring. The waist-drum spring may have a thin cylindrical shape with an inner diameter which is the smallest at an intermediate portion and gradually increases from the intermediate portion toward both ends. The first inner conductor 1102 may be inserted into the waist-drum spring and may deform the waist-drum spring when the second coaxial connector portion 120 floats radially relative to the first coaxial connector portion 110. The waist-drum spring may deform axially (being elongated) and radially (the inner diameter of the intermediate portion becomes larger) at the same time under the action of the first inner conductor 1102.

Additionally, in embodiments according to the present disclosure, the threads 1204 on the second outer conductor 1201 of the second coaxial connector portion 120 may be constructed as reverse threads. The connecting/disconnecting operation of the reverse threads is opposite to the connecting/disconnecting operation of normal threads. This can avoid the possibility that the second coaxial connector portion 120 cannot be rotated due to pressing of the first elastic element 130 when connecting the first coaxial connector portion 110 to the second coaxial connector portion 120, and can also avoid the possibility that the first coaxial connector portion 110 and the second coaxial connector portion 120 is separated due to misoperation of operators.

Figure 5:
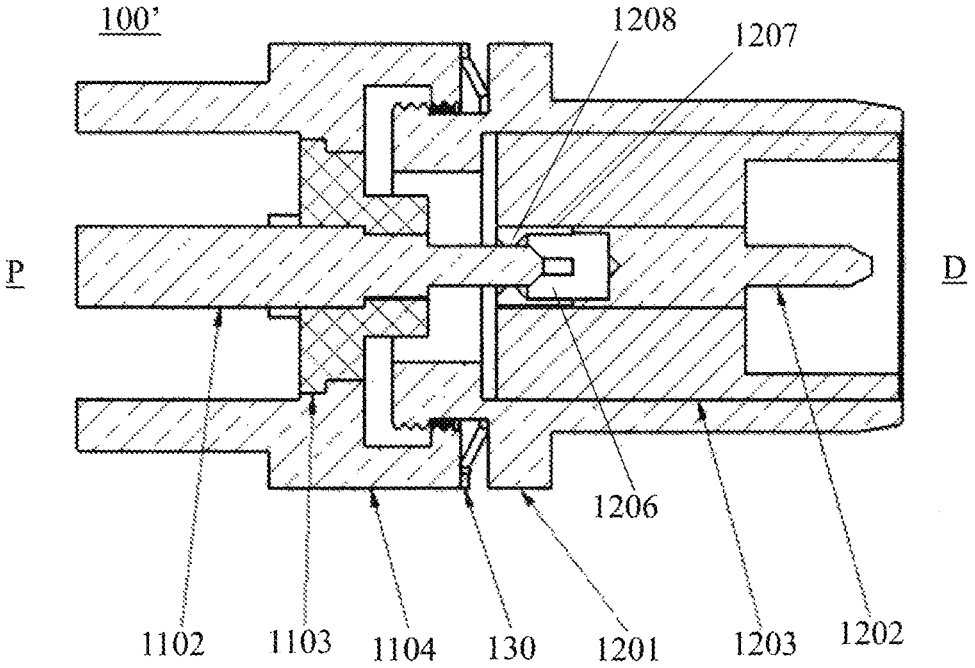
FIG. 5 is a cross-sectional view of the first coaxial connector according to another embodiment of the present disclosure.

FIG. 5 illustrates a first coaxial connector 100' according to another embodiment of the present disclosure. In the first coaxial connector 100', the proximal portion of the second inner conductor 1202 of the second coaxial connector portion 120 includes a plurality of resilient fingers 1207 disposed in a circumferential direction. The proximal end of each resilient finger 1207 is provided with a protrusion 1208 protruding radially inwardly. The protrusion 1208 has an arc-shaped outer surface. The first inner conductor 1102 of the first coaxial connector portion 110 may be inserted into the cavity 1206 enclosed by the plurality of resilient fingers 1207 and be in contact with the protrusion 1208 of each resilient finger 1207. As the protrusion 1208 has an arc-shaped outer surface, the first inner conductor 1102 can always be in contact with the protrusion 1208 when the second coaxial connector portion 120 floats radially relative to the first coaxial connector portion 110, thereby ensuring the electrical connection between the first inner conductor 1102 and the second inner conductor 1202.

The resilient fingers 1207 may protrude from the second dielectric spacer 1203 or may be surrounded by the second dielectric spacer 1203 (as shown in FIG. 5). When the resilient finger 1207 is surrounded by the second dielectric spacer 1203, an outer circumferential surface of the resilient finger 1207 may be spaced apart from an inner circumferential surface of the second dielectric spacer 1203 by a distance so as to allow some radial deformation of the resilient finger 1207, thereby not obstructing the radial floating of the second coaxial connector portion 120 relative to the first coaxial connector portion 110.

Figure 6:
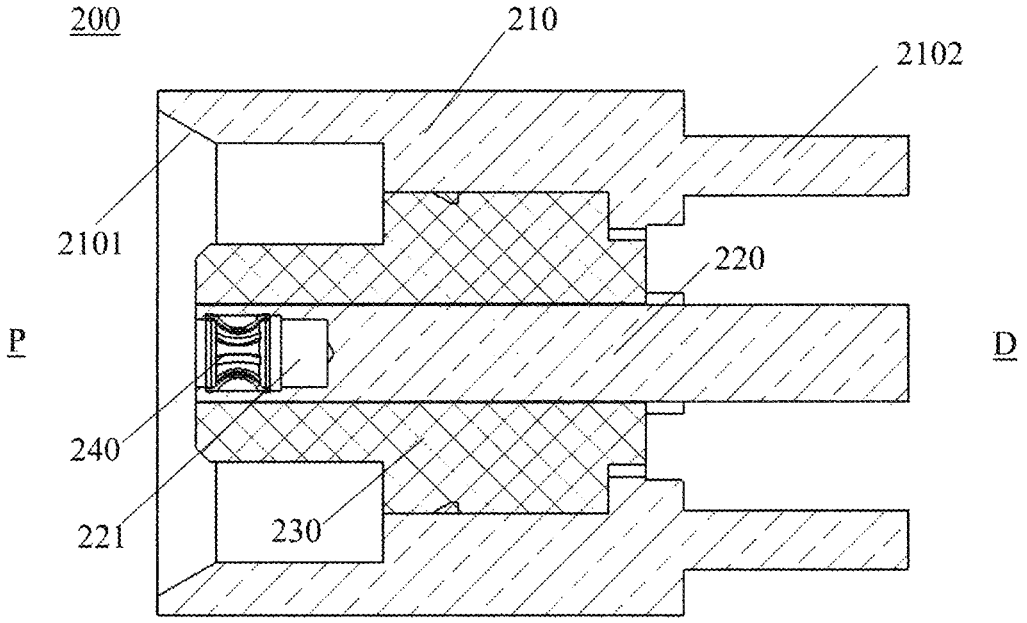
FIG. 6 is a cross-sectional view of a second coaxial connector according to an embodiment of the present disclosure.

Referring next to FIG. 6, a specific structure of the second coaxial connector 200 according to one embodiment of the present disclosure is illustrated. The second coaxial connector 200 may be constructed as a female connector, and may include an outer conductor 210, an inner conductor 220, and a dielectric spacer 230 disposed between the outer conductor 210 and the inner conductor 220 and spacing them from each other. The outer conductor 210 may have a generally cylindrical shape. A proximal portion of the outer conductor 210 may include a tapered inner circumferential surface 2101 to facilitate insertion of the outer conductor 110 of the first coaxial connector 100. A distal portion of the outer conductor 210 may include at least one pin 2102 extending axially toward the distal side D. By means of pins 2102, the outer conductor 210 may be welded on the second printed circuit board 12. In embodiments according to the present disclosure, the inner conductor 220 may be configured as an elongated element such as a pin or a post. A proximal portion of the inner conductor 220 includes a cavity 221. The second inner conductor 1202 of the first coaxial connector 100 may be inserted into the cavity 221 to achieve mating and electrical connection of the first coaxial connector 100 with the second coaxial connector 200.

As shown in FIG. 6, a third elastic element 240 may be disposed in the cavity 221 to facilitate blind mating of the first coaxial connector 100 with the second coaxial connector 200, and to enable the first coaxial connector 100 to be tilted at an angle relative to the second coaxial connector 200 when mated with the second coaxial connector 200. The third elastic element 240 may be configured in the form of a waist-drum spring like the second elastic element 140. Further, the proximal portion of the inner conductor 220 may also be configured to include a plurality of resilient fingers disposed in the circumferential direction as shown in FIG. 5. The proximal end of each resilient finger may be provided with a protrusion protruding radially inwardly, and the protrusion may have an arc-shaped outer surface. The second inner conductor 1202 of the first coaxial connector 100 may be inserted into a cavity surrounded by the plurality of resilient fingers and be in contact with the protrusion of each resilient finger, so as to achieve mating and electrical connection of the first coaxial connector 100 with the second coaxial connector 200.

Figure 7B:
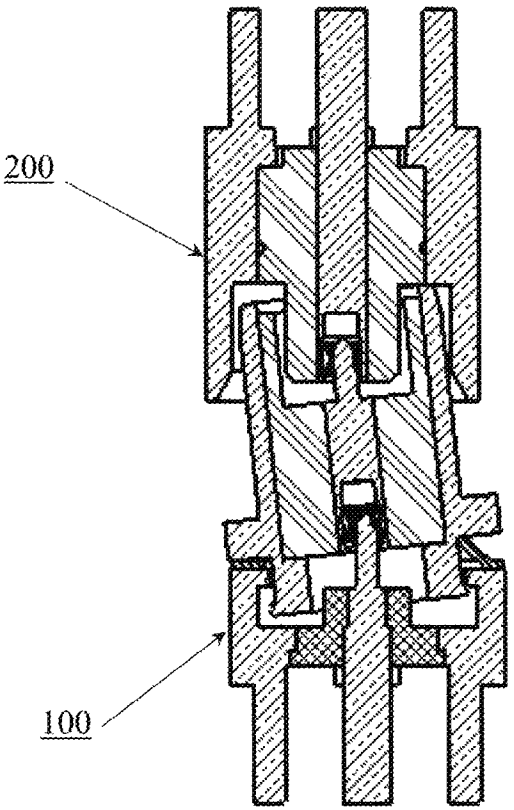
FIGS. 7*a* and 7*b* show two different mating states of the first coaxial connector and the second coaxial connector respectively.
Figure 7A:
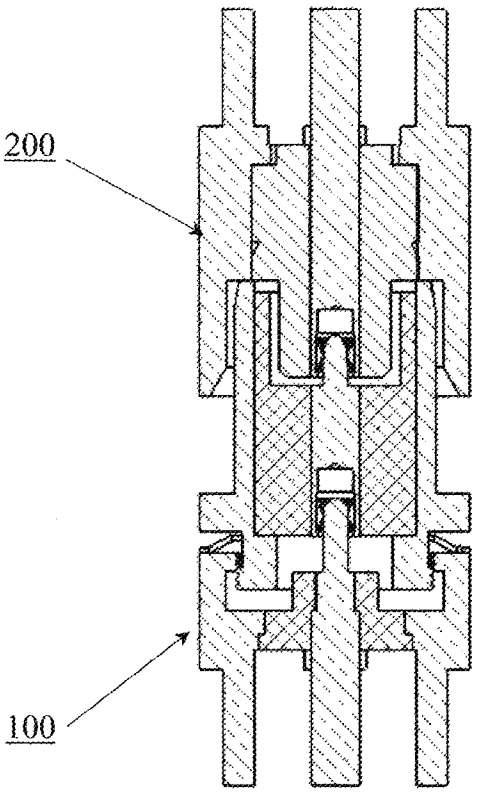

Referring to FIGS. 7*a* and 7*b*, two different mating states of the first coaxial connector 100 and the second coaxial connector 200 are illustrated. In the embodiment illustrated in FIG. 7*a*, the first coaxial connector 100 is kept substantially coaxial with the second coaxial connector 200, which is an ideal mated state. However, in the embodiment shown in FIG. 7*b*, the first coaxial connector 100 is floated radially (tilted) at an angle relative to the second coaxial connector 200. In this mated state, due to the presence of the first elastic element 130 and the second elastic element 140 (and the possible third elastic element 240), the first coaxial connector 100 and the second coaxial connector 200 can be maintained in a good condition of contact, thereby relieving the deterioration of the return loss performance compared with the conventional coaxial connectors and ensuring good dynamic PIM characteristics.

In addition, the first coaxial connector 100 according to the present disclosure is also floatable axially in the embodiment shown in FIG. 7*a*, so as to adjust the length of the first coaxial connector 100 to make the first coaxial connector 100 as well as the second coaxial connector 200 mating with the first coaxial connector applicable between two printed circuit boards at different intervals.

In embodiments according to the present disclosure, the outer conductor 110 and the inner conductor 120 of the first coaxial connector 100 and the outer conductor 210 and the inner conductor 220 of the second coaxial connector 200 may be made of beryllium copper. The first elastic element 130, the second elastic element 140, and the third elastic element 240 may be made of beryllium copper or phosphor copper.

In embodiments according to the present disclosure, the first coaxial connector 100 and the second coaxial connector 200 may comprise various types of connector interfaces, such as a 4.3-10 female connector interface. a 2.2-5 connector interface, a DIN connector interface, a NEX10 connector interface, an SMA connector interface, an N-type connector interface, a 7/16 radio frequency connector interface, and the like.

Although exemplary embodiments of this disclosure have been described, those skilled in the art should appreciate that many variations and modifications are possible in the exemplary embodiments without departing from the spirit and scope of the present disclosure. Accordingly, all such variations and modifications are intended to be included within the scope of this disclosure as defined in the claims.

What is claimed is:

1. A coaxial connector, characterized in that the coaxial connector comprises:

a first coaxial connector portion including a first outer conductor, a first inner conductor, and a first dielectric spacer disposed between the first outer conductor and the first inner conductor;

a second coaxial connector portion including a second outer conductor, a second inner conductor, and a second dielectric spacer disposed between the second outer conductor and the second inner conductor; and a first elastic element disposed between the first outer conductor of the first coaxial connector portion and the second outer conductor of the second coaxial connector portion;

wherein the first elastic element is configured such that the second coaxial connector portion is floatable axially and radially relative to the first coaxial connector portion, and the first elastic element is adapted to form an electrical connection between the first outer conductor and the second outer conductor:

wherein an inner circumferential surface of the first outer conductor is provided with threads, and an outer circumferential surface of the second outer conductor is provided with mating threads, wherein the mating threads is capable of being screwed beyond the threads and into the first coaxial connector portion.

2. The coaxial connector according to claim 1, characterized in that the first elastic element is a leaf spring.

3. The coaxial connector according to claim 1, characterized in that the first elastic element is made of beryllium copper or phosphor copper.

4. The coaxial connector according to claim 1, characterized in that the first inner conductor is in the form of a pin or a post, a proximal portion of the second inner conductor is provided with an elastic component, wherein the first inner conductor is configured to be in contact with the elastic component to form an electrical connection between the first inner conductor and the second inner conductor.

5. The coaxial connector according to claim 4, characterized in that the elastic component is a second elastic element, wherein the proximal portion of the second inner conductor includes a cavity for receiving the first inner conductor, and the second elastic element is disposed in the cavity.

6. The coaxial connector according to claim 5, characterized in that the second elastic element is a waist-drum spring.

7. The coaxial connector according to claim 5, characterized in that the second elastic element is made of beryllium copper or phosphor copper.

8. The coaxial connector according to claim 4, characterized in that the elastic component is configured to include a plurality of resilient fingers disposed in a circumferential direction, and a proximal end of each resilient finger is provided with a protrusion protruding radially inwardly, wherein the protrusion has an arc-shaped outer surface.

9. The coaxial connector according to claim 1, characterized in that the mating threads are configured as reverse threads.

10. A board-to-board connector assembly, characterized in that the board-to-board connector assembly comprises:

a first printed circuit board and a second printed circuit board disposed substantially parallel to each other, at least one first coaxial connector mounted to the first printed circuit board, the first coaxial connector comprising:

a first coaxial connector portion including a first outer conductor, a first inner conductor, and a first dielectric spacer disposed between the first outer conductor and the first inner conductor;

a second coaxial connector portion including a second outer conductor, a second inner conductor, and a second dielectric spacer disposed between the second outer conductor and the second inner conductor; and a first elastic element disposed between the first outer conductor of the first coaxial connector portion and the second outer conductor of the second coaxial connector portion;

wherein the first elastic element is configured such that the second coaxial connector portion is floatable axially and radially relative to the first coaxial connector portion, and the first elastic element is adapted to form an electrical connection between the first outer conductor and the second outer conductor; and the assembly further comprising at least one second coaxial connector mounted to the second printed circuit board, wherein the second coaxial connector is capable of mating with the first coaxial connector, the second coaxial connector includes an outer conductor, an inner conductor, and a dielectric spacer disposed between the outer conductor and the inner conductor of the second coaxial connector, wherein a proximal portion of the inner conductor of the second coaxial connector is provided with a third elastic element, and the second inner conductor of the first coaxial connector is configured to contact the third elastic element of the inner conductor of the second coaxial connector so as to form an electrical connection between the second inner conductor of the first coaxial connector and the inner conductor of the second coaxial connector; and wherein the proximal portion of the inner conductor of the second coaxial connector includes a cavity for receiving the second inner conductor of the first coaxial connector, wherein the third elastic element is disposed in the cavity.

11. The board-to-board connector assembly according to claim 10, characterized in that the third elastic element is a waist-drum spring.

12. The board-to-board connector assembly according to claim 10, characterized in that the third elastic element is made of beryllium copper or phosphor copper.

13. The board-to-board connector assembly according to claim 10, characterized in that the board-to-board connector assembly includes a plurality of first coaxial connectors and a plurality of second coaxial connectors, wherein the plurality of first coaxial connectors and the plurality of second coaxial connectors are disposed on the first printed circuit board and the second printed circuit board respectively in a same array.

14. The board-to-board connector assembly according to claim 10, characterized in that the first printed circuit board is mounted on a base station antenna, and the second printed circuit board is mounted on a remote radio unit.

* * * * *